United States Patent [19]

Carrick

[11] Patent Number: 4,638,761

[45] Date of Patent: Jan. 27, 1987

[54] APPLICATOR FOR COATING SUSPENDED CABLE

[76] Inventor: Lee Carrick, 2 Jefferson Ct., Grosse Pointe, Mich. 48230

[21] Appl. No.: 722,791

[22] Filed: Apr. 12, 1985

Related U.S. Application Data

[63] Continuation-in-part of Ser. No. 628,857, Jul. 9, 1984, abandoned.

[51] Int. Cl.[4] ..... B05C 1/08; B05C 5/00

[52] U.S. Cl. ..... 118/694; 118/208; 118/307; 118/DIG. 20; 184/17; 401/208

[58] Field of Search ..... 118/208, DIG. 20, 307, 118/694; 184/17; 401/208, 219

[56] References Cited

U.S. PATENT DOCUMENTS

| | | | |
|---|---|---|---|
| 348,535 | 8/1886 | Rosenblatt | 118/307 X |
| 632,653 | 9/1899 | Lewis | 118/108 |
| 825,785 | 7/1906 | Welman | 118/208 |
| 1,269,956 | 6/1918 | Parr | 118/208 |
| 2,651,288 | 9/1953 | Reigh | 118/208 X |
| 3,707,859 | 1/1973 | Carr et al. | 118/694 X |
| 4,174,678 | 11/1979 | Van Den Bergh | 118/307 |

*Primary Examiner*—John P. McIntosh

*Attorney, Agent, or Firm*—Gifford, Groh, VanOphem, Sheridan, Sprinkle & Dolgorukov

[57] ABSTRACT

A coating applicator for a suspended cable comprises a housing defining a coating reservoir and having a roller rotatably mounted in said housing that is at least partly immersed in the coating reservoir. The coating roller includes a peripheral groove defined by tapered walls adapted to receive the cable therein. In one form of the invention, a pair of brackets support suspension rollers from opposite sides of the housing so that each suspension roller is spaced from the other and aligned over the groove in the coating roller from opposite sides of the cable. The housing includes a fluid coupling for connection with a conduit in fluid communication between the coating reservoir and a reversible pump which is in fluid communication with a supply reservoir, so that a predetermined level of fluid can be maintained in the coating reservoir and so that the coating can be drained from the reservoir when the coating operation is completed. A portion of the conduit can be rigid so that the rigid structure forms a handle for maneuvering the applicator. Another form of the invention comprises an open top housing which can be closed by a lid pivotally mounted to the housing. In such a housing, one or more spray nozzles can be used to discharge coating at extremely high pressure on the cable.

27 Claims, 9 Drawing Figures

APPLICATOR FOR COATING SUSPENDED CABLE

CROSS REFERENCE TO RELATED APPLICATION

The present application is a continuation-in-part of Application Ser. No. 628,857 filed July 9, 1984 entitled AN APPLICATOR FOR COATING SUSPENDED CABLE now abandoned.

BACKGROUND OF THE INVENTION

1. Field of the Present Invention

The present invention relates generally to applicators for coating a surface, and more particularly, to an applicator having a housing adapted to be suspended from and receive a suspended cable for providing a coating to the cable.

2. Description of the Prior Art

Suspended cable often requires maintenance or repair by the application of a protective or insulating coating to prolong the life of the cable. While many coatings are applied while they are in a liquid flowable state, the previously known methods and apparatus for applying coatings can be difficult to control and operate.

One previously known method for coating suspended cable comprises the use of spray applicators. The disadvantage of spraying coatings is that a substantial amount of coating oversprays the surface of the cable and is spread throughout the environment surrounding the cable. Moreover, since the spray nozzle sprays in substantially a single direction, a single spray nozzle must be manipulated in many directions before the entire periphery of the cable will be coated. Moreover, to provide a plurality of nozzles which coat all surfaces of the cable simultaneously would substantially increase the complexity and cost of the spray applicator.

Another known form of applicator for suspended cables is disclosed in U.S. Pat. No. 439,916 to Whittlesey. Whittlesey discloses a reservoir device adapted to be supported on a cable-engaging mast structure including a rotatable roller immersed in the reservoir of coating. The roller spreads coating upon the surface of the cable as it rolls along the cable. However, the reservoir of whittlesey holds a limited supply of coating which must be continuously replenished in order to continue coating the cable over long distances. Thus, the reservoir must repeatedly be removed from the mast structure in order to replenish the supply. Since suspended cables are often at a height substantially above ground surface, replenishing the supply of coating can be a time consuming task. Moreover, with the device disclosed in the Whittlesey patent, the coating can be applied to the cable only as it is being used by the cable-engaging mast structure and it is not independently operable.

Other devices for coating suspended cables such as concave brushes are difficult to manipulate and maneuver upon unsupported portions of suspended cable and can require substantial labor to fully apply a coating on the suspended cable. Moreover, the previously-known coating apparatus are not well adapted for use on dual suspension cables in which an insulated transmission cable is suspended from a support cable by rigid straps. In such cable systems, providing a coating is especially important because the straps are often metal and can cut into or cause deterioration of the insulation layer of the suspended cable.

SUMMARY OF THE PRESENT INVENTION

The present invention overcomes the above-mentioned disadvantages by providing an apparatus for applying a flowable coating to suspended cables in which an applicator is mounted in a housing defining a reservoir for the coating, and wherein the housing includes fluid passage means for supplying the coating to the reservoir. In addition, the fluid passage means can be used for draining fluid from the reservoir. The applicator can be in the form of a grooved roller rotatably mounted in the housing and in communication with the reservoir, or at least one spray nozzle or it can be a combination of coating roller and nozzles. Moreover, the present invention includes means for independently suspending the housing from the cable which permits the housing to be easily detached from or attached to the cable. Furthermore, when a coating roller is used, it is grooved and particularly configured so that substantially the entire periphery of the cable is coated as the roller rolls along the length of the cable. Similarly, the positioning of nozzles is also arranged to assure that the entire periphery of the cable is coated with a minimum number of nozzles.

In general, the applicator comprises an open top housing defining a coating reservoir and having means for supporting a coating applicator in the housing. When the applicator includes a coating roller, the roller is preferably formed from a resilient but deformable foam or sponge type material, and includes a circumferential groove adapted to receive the cable. At least a portion of the roller extends into the reservoir below the level of fluid in the reservoir so that the periphery of the roller is continuously supplied with coating material. A support roller is positioned above the coating roller by a support means secured to one side of the housing so that the support roller is easily engaged over the cable by positioning the supported end of the roller adjacent the side of the cable as the housing is raised to position the roller above the cable. Likewise, such a connection enables the housing to be easily removed from the cable by raising and disengaging the support roller from the top of the cable and then rotating the housing so that the roller can be lowered adjacent the side of the cable.

When a coating roller is used, the housing also includes a fluid passage means in fluid communication with the coating reservoir so that the reservoir can be supplied to a predetermined level with fluid and so that the reservoir can be drained when use of the applicator is to be discontinued. Preferably, the fluid passage means is connected by a conduit to a pump which pumps coating material into the coating reservoir from a supply reservoir which can be remotely positioned from the applicator housing and conveniently supported by a vehicle or the like traveling along the ground. Preferably, the pump is controlled by a switch electrically connected to a thermistor mounted in the housing, so that a predetermined level of coating material is maintained in the coating reservoir during operation of the applicator. When the applicator is to be removed from the suspended cable, the coating material is drained from the coating reservoir, preferably by gravity, so that spillage of the coating material is avoided while the applicator is being maneuvered for removal from the suspended cable.

In another form of the preferred embodiment, the housing includes a lid hinged at one side of the housing so that it can be selectively positioned to open and close the top of the housing. The lid includes means for adjustably mounting support rollers so that the axial position of the rollers can be adjusted to accommodate dual cable suspensions regardless of differences in distance between the suspended cables. Moreover, the lid supports a nozzle adapted to discharge coating under high pressure in a spray pattern downwardly upon the cable.

Moreover, the coating roller used in a preferred embodiment has a groove deeper than the diameter of the cable so that the cable is disposed within the groove of the applicator. Moreover, it is preferable that the groove be defined by inwardly tapering walls so that the flowable coating is applied to the top and sides of the cable as well as the bottom of the cable which rests against the side walls of the groove in the roller. By maintaining a predetermined level of fluid in the reservoir, the rotation of the roller in the reservoir delivers a sufficient amount of coating material to coat the entire exposed surface of the cable.

In addition, in the preferred embodiment of the present invention, the applicator is particularly adapted for coating dual suspension cables, which employ a support cable and an insulated transmission cable suspended from the support cable by rigid straps. This is accomplished by making the support rollers interchangeable with rollers of various sizes, or by adjusting the position of the support roller axle with respect to the coating roller so that the insulated transmission cable is pressed into the roller material at the bottom of the groove of the coating roller, thus deforming the side walls of the groove to extend partly over the top of the insulated cable. However, other means for adjusting the height of the space intermediate the support rollers and the coating roller are also within the scope of the present invention. In addition, in the preferred embodiment, the conduit communicating between the coating reservoir and the supply reservoir is at least partly made of a rigid material so that the conduit forms a handle for maneuvering the applicator. Rigid conduits of various lengths can be used depending upon the height of the cable above a support surface from which the applicator is operated.

Thus, the present invention provides an applicator for cable coating which does not require repeated realignment of the applicator in order to coat the entire surface of the cable. Moreover, the applicator can be independently suspended from the cable and independently maneuvered without the need for preexisting cable engaging devices such as trolley rails. Moreover, the applicator avoids overspray, and can prevent waste of the coating material by enabling the suspended coating reservoir to be drained before removal of the applicator from the cable. As a result, the applicator can be safely and easily manuevered by an operator. Also the operator need not repeatedly attach and remove the applicator as required by previously known cable coating apparatus to maintain a sufficient supply of coating material in the applicator throughout a long period of use. These and other advantages of the present invention will become more apparent hereinafter as the preferred embodiment of the present invention is described in detail.

BRIEF DESCRIPTION OF THE DRAWING

The present invention will be more clearly understood by reference to the following detailed description of a preferred embodiment of the present invention when read in conjunction with the accompanying drawings in which like reference characters refer to like parts throughout the views and in which.

DETAILED DESCRIPTION OF A PREFERRED EMBODIMENT OF THE PRESENT INVENTION

Figure 1:
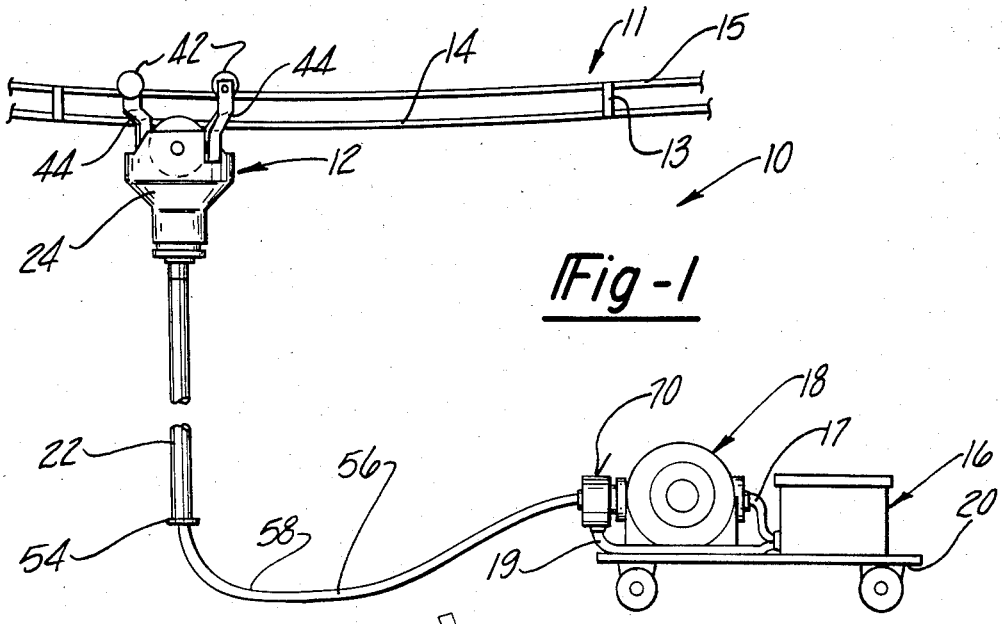
FIG. 1 is a side plan view of a cable coating apparatus constructed in accordance with the present invention.

Referring first to FIG. 1, an applicator apparatus 10 according to the present invention is thereshown as comprising a cable coating applicator 12 suspended from a dual suspension cable 11 having an insulated transmission cable 14 suspended by straps 13 from a suspended support cable 15. The applicator 12 comprises an open-topped housing 24 defining a coating reservoir 26 (FIG. 2) which fluidly communicates through a conduit 56 with a supply reservoir 16 through a pump 18 and a return line 19. The pump 18 is controlled by a switch means 70 having a control lever (not shown) so that coating from the supply reservoir 16 can be pumped into and maintained at a predetermined level in the applicator 12. In order to drain the housing 24 when it is to be removed from the cables 11, the switch means 70 deactivates the pump 18 and fluidly connects the conduit 56, and thus the coating reservoir 26 (FIG. 2), to the supply reservoir 16 through the return line 19. The pump 18 and the supply reservoir 16 are mounted on a movable carriage 20 which permits the pump 18 and the supply reservoir 16 to travel along the ground beneath the cables 11.

Still referring to FIG. 1, the conduit 56 comprises a rigid portion 22 and a flexible portion 58. The rigid portion 22 is fixedly secured at one end to the applicator housing 24 so that the applicator 12 can be maneuvered, attached to, and removed from the suspended cable 15. The rigid conduit portion 22 is interchangeable with other rigid conduit portions 22 of various lengths depending upon the height of the cable above the ground surface or above a raised working platform on which an operator is positioned. For example, if a cherry-picker-type work station, which enables a work platform to be raised to any desired height, is used, the conduit section can be substantially shorter than would be necessary if an operator were standing on a ground surface below the suspended cable 15.

Figure 2:
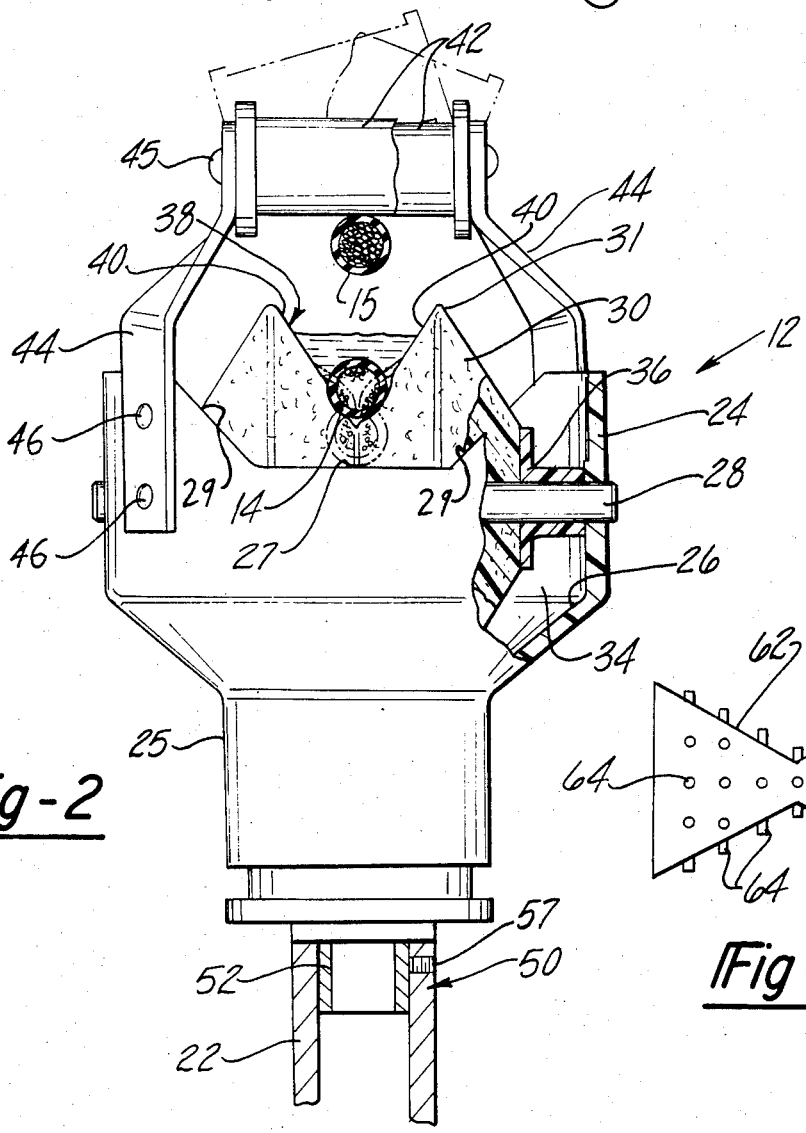
FIG. 2 is an end plan view of a portion of the apparatus shown in FIG. 1, with parts broken away for the purpose of clarity.

The housing 24 of the applicator 12, as best shown in FIG. 2, supports an axle 28 which extends through the peripheral wall of the housing 24 across the coating reservoir 26. The axle 28 rotatably support coating roller 30 in the upper portion of the housing 24. A portion of the roller 30 extends into the coating reservoir 26 so as to be partly immersed below the level 34 of coating in the coating reservoir 26. Spacer bearings 36 on each side of the roller 30 position the roller substantially in the center of the housing 24. The roller 30 includes a central peripheral groove 38 defined by tapered or inclined wall portions 40 which is adapted to receive a transmission cable 14 therein. The roller 30 is made of a porous, deformable material so as to be capable of contact with a substantial portion of the periphery of the cable 14 as the cable 14 is pressed into the roller 30 as will be described in greater detail hereinafter.

The top rim of the housing 24 is recessed forwardly and rearwardly of the roller 30 to permit compression of the roller 30. The recessed portions 27 extend across the roller 30 substantially the same distance as the distance between the peaks 31 of roller 30 and mate with the higher wall surfaces laterally adjacent the sides of the roller 30 by ramp edge portions 29. The recessed portions 27 and the ramp edge portions 29 facilitate the attachment of the applicator 12 to a suspended cable 15 as will be described hereinafter.

A pair of support rollers 42 extend above the groove 38 at spaced apart positions as best shown in FIGS. 1 and 3–5. Each support roller 42 is rotatably supported from one side of the housing 24 by a bracket 44 secured to the periphery of the housing 24. Each of the brackets 44 is secured by a plurality of fasteners 46 (FIGS. 2 and 4) to the side of the housing 24 with one bracket 44 on each side of the housing 24 so that the housing 24 remains suspended from the support cable 15 even when the housing 24 is displaced sideways and the cable inadvertently disengages from the support rollers 42.

Of course, the use of spaced-apart support rollers 42 provides stability for the housing 24 and enables it to maintain a level position to avoid spillage of the coating from the reservoir 26. It is to be understood that a single roller or other roller constructions could be used to suspend the housing 24 from the suspended cable 15 without departing from the scope of the present invention. However, the advantages of the preferred embodiment in which spaced-apart rollers 42 are supported from opposite sides of the housing 24 are that inadvertent disengagement from the suspended cable 15 can be avoided and that the coating reservoir 26 is maintained at a level position on the suspended cable 15.

Other constructions, however, could be used to accomplish the same purpose. For example, the bracket 44 could be avoided if the sides of the housing 24 were high enough to support the support rollers 42 at the desired position above the coating roller 30.

Figure 4:
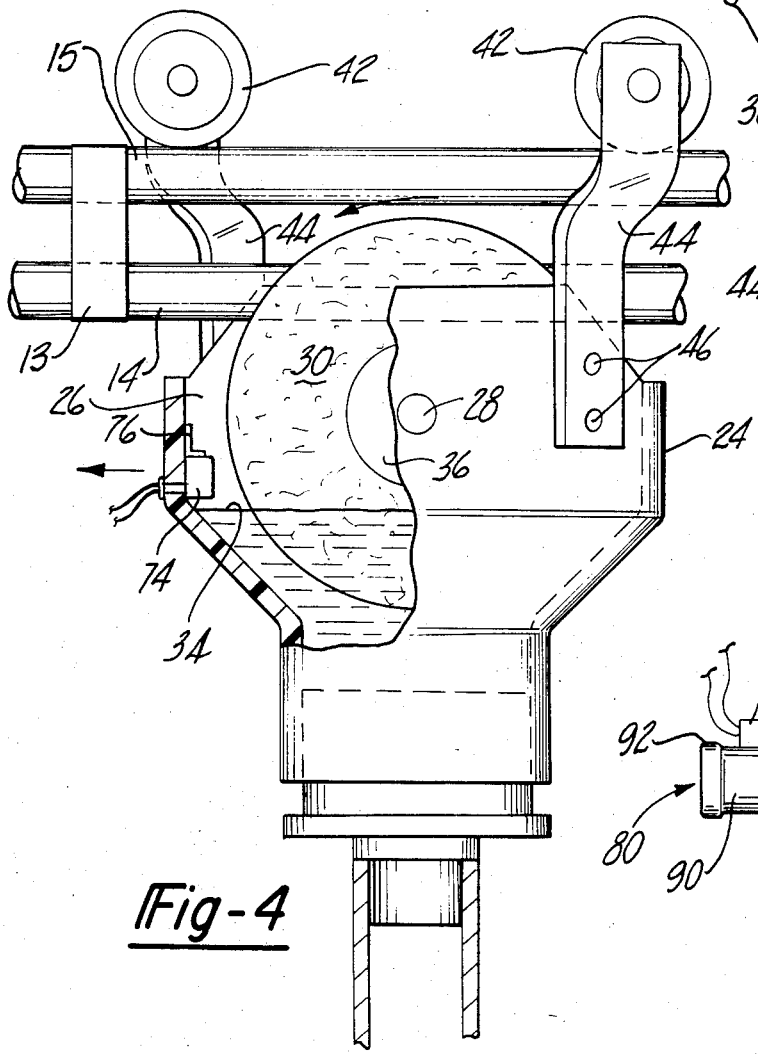
FIG. 4 is a side elevation of a portion of the apparatus shown in FIGS. 2 and 3.

Moreover, as best shown in FIGS. 2 and 4, the support rollers 42 are spaced above the coating roller 30 so as to engage the top of support cable 15 when the transmission cable 14 is carried in groove 38 of coating roller 30. Moreover, the spacing can be slightly less than the distance between the bottom of groove 38 and the surface of support rollers 42 so that the coating roller 30 is compressed toward axle 28. Alternatively, the coating roller 30 is compressed by lifting the housing 24 upward and forcing the coating roller 30 against the transmission cable 14. In either event, during compression, the side walls 40 bulge over the centerline of the transmission cable 14 and contact top portions of the transmission cable 14, as shown in phantom line in FIG. 2. Nevertheless, the support rollers 42 can be removed from the support axles 45 by removing the nuts 47 (FIG. 3) retaining them in position on the support axles 45, and replaced with support rollers of a different width or diameter as desired. For example, the support rollers 42 can be replaced with smaller or larger diameter support rollers to adjust the applicator for use with dual cable systems having straps 13 of a different length, or for use with a single suspended cable.

Referring now to FIG. 2, the lowermost portion of the housing 24 includes fluid coupling means 50 in the form of a nipple 52 which can be inserted into the rigid conduit portion 22. Nippled 52 is tightly engaged within the rigid conduit portion 22 and can be locked thereto by means of a set screw 57. As best shown in FIG. 1, the other end of rigid conduit portion 22 is adapted to be coupled in fluid communication with the end of the conduit 58 by fluid coupling 54 to thereby connect the housing 24 to the switch means 70.

Referring now to FIG. 4, the switch means 70 (FIG. 7) is electrically connected to a thermistor 74 mounted by a bracket 76 to the inside of the housing 24 at the desired level to which the coating reservoir 26 is to be filled. When the level of coating material rises sufficiently to contact the thermistor 74, the thermistor 74 causes an open circuit and deactivates the pump 18. Conversely, when the coating level is below the level of the thermistor 74, the circuit is closed and the pump 18 delivers coating material to the coating reservoir 26 from supply reservoir 16 (FIG. 1).

Figure 7:
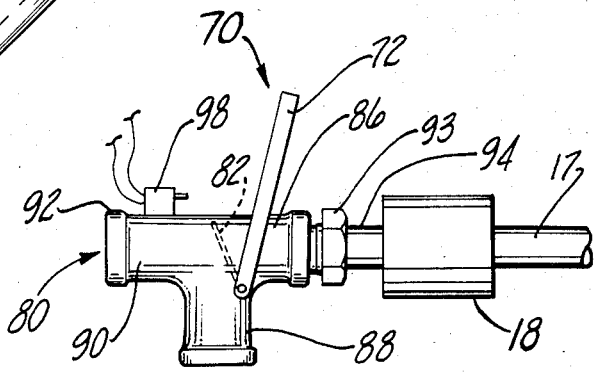
FIG. 7 is a diagrammatic view of a portion of the apparatus as shown in FIG. 1.

As shown in FIG. 7, the switch means 70 includes a T-type fluid coupling 80 having a pivoting gate valve 82. The gate valve 82 is pivoted by means of a lever 72 to and between a first position closing a fluid passageway 88 and a second position closing fluid passageway 86 is secured by a fluid coupling 92 to an end of conduit 56 (not shown). Fluid passageway 86 is coupled by a coupling 93 to the outlet 94 of the pump 18. The fluid passageway 88 is fluidly connected to return line 19 (FIG. 1). When lever 72 is is in the first position (not shown), the gate valve 82 closes the passageway 88 while the lever 72 closes the electrical contacts of a switch 98 to electrically connect the pump 18 to a power source (not shown). The switch 98 is electrically connected in series with the thermistor 74.

Figure 5:
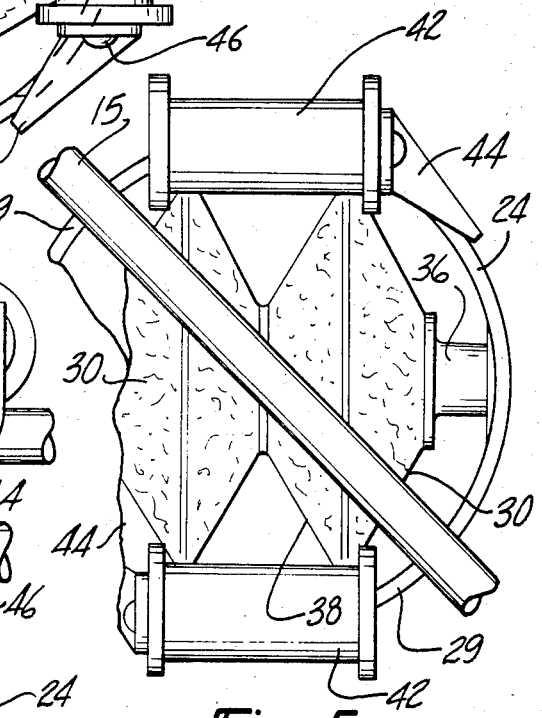
FIG. 5 is a fragmentary top plan view similar to FIG. 3 but showing the apparatus in a rotated position.

Having thus described the important structural features of the form of the present invention shown in FIGS. 1–7, the operation of the applicator according to the present invention will now be described. As shown in FIG. 5, the applicator 12 is raised toward the suspended cable 15 so that the support rollers 42 extend adjacent the sides of the cables 11 and the transmission cable 14 extends across the ramp edges 29. When the transmission cable 14 engages the outermost portion of the coating roller 30, and is urged toward the support cable 15, the housing 24 is rotated through approximately 90° so that support rollers 42 slide over and extend across the top of the support cable 15 for rolling movement therealong in the position shown in FIGS. 3 and 4. At the same time, the lower transmission cable 14 slides down the ramp edges 29 and engages with the groove 38 of the coating roller 30. Moreover, as shown in phantom line in FIG. 2, slight flexibility in the brackets 44 permits a slight expansion of the distance between the support rollers 42 and the coating roller 30 to permit installation despite the inflexibility of rigid straps 13. It is to be understood that other means for temporarily expanding the distance between and support rollers 42 and the coating roller 30, such as a single mounting pin which permits limited movement of the bracket in the manner shown in FIG. 2, are also within the scope of the present invention. Moreover, since the removal procedure is substantially the reverse of the installation procedure, the above discussed features are also useful for removal of the applicator 12 from the cables 11.

The spacing between the support cable 15 and transmission cable 14 maintained by the rigid straps 13 urges the transmission cable 14 to compress the coating roller 30 as shown in phantom line in FIG. 2. Alternatively, such as when a single cable is suspended, compression of the coating roller 30 can be accomplished by lifting the applicator 12 by the rigid conduit section 22 and thereby pressing the coating roller 30 against the transmission cable 14. In either event, the deformation of the walls 40 extends over a portion of the top of the transmission cable 14 to apply flowable coating thereon.

The housing 24 is then urged by the elongated, rigid conduit 22 along the cables 14 and 15 with the transmission cable 14 engaged in the bottom of the groove 38. As the coating roller 30 rolls along the transmission cable 14, the supply of a flowable coating, which is typically rather viscous and cohesive, sticks to the tapered wall 40 as the immersed portion of the coating roller 30 rotates upward toward engagement with the cable 14. Since the cable 14 is engaged in the bottom of the groove 38, flowable coating extends over the top and sides of the cable, as well as the bottom, in order to coat substantially the entire periphery of the transmission cable 14. The coating also flows over the strap portions engaging the transmission cable 14 so as to cover the cut or deteriorated portions of the insulation on transmission cable 14.

The coating within the coating reservoir 26 is maintained at the predetermined level 34 by the switch means 70 and the thermistor 74 so that a portion of the coating roller 30 remains submersed within the coating to cause adhesion of a sufficient amount of coating to the coating roller 30 for application to the transmission cable 14. The switch means 70 and the thermistor 74 also prevent over-filling of the coating reservoir 26. However, when it is desired to disengage the applicator 12 from the cable 14, the lever 72 is reversed so the pump 18 is deactivated and the coating is drained from the coating reservoir 26 through the return line 19 into the supply reservoir 16. Once the coating reservoir 26 has been drained, the housing 24 can be manipulated so that the applicator 12 can be disengaged from the cables 11 without risk of inadvertently spilling any coating from the housing 24. In addition, removal of the coating from the coating reservoir 26, the rigid conduit 22, and the flexible conduit portion 58 the weight of the applicator 12 and thus contribute to ease in the handling and maneuverability of the applicator 12 by a worker. Nevertheless, the applicator 12 need not be repeatedly removed from and attached to the cables 11 in order to maintain the level 34 of coating in the applicator 12 at a level sufficient to provide a complete coating of the transmission cable 14 as the applicator 12 is moved therealong.

Figure 6:
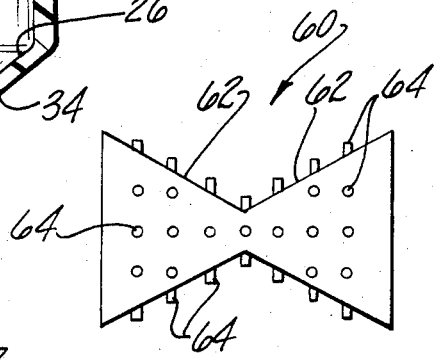
FIG. 6 is a side plan view of a modified suspension roller for the apparatus of FIGS. 1–5.
Figure 3:
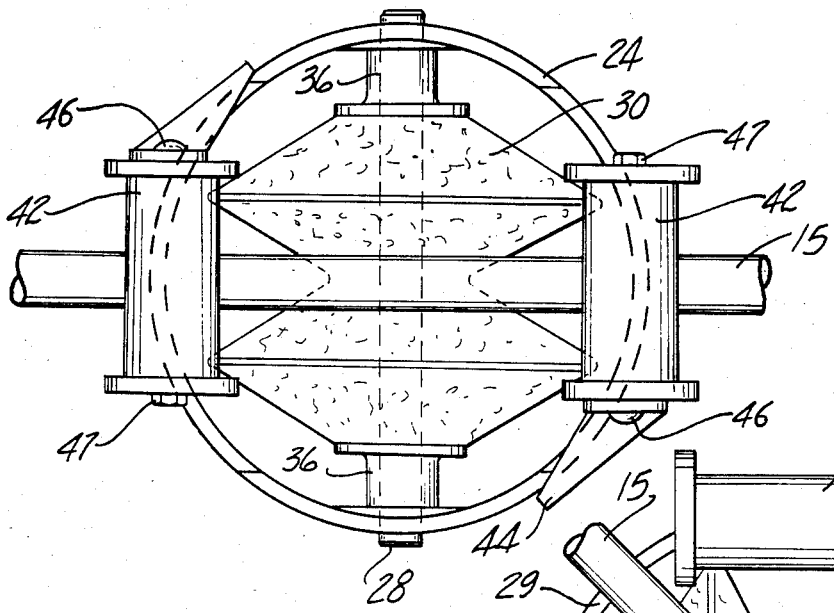
FIG. 3 is a top plan view of a portion of the apparatus shown in FIG. 2.

Referring now to FIG. 6, a modified form of a support roller is adapted for use when a single cable is suspended without a support cable. The modified roller comprises a spool 60 having inwardly tapering peripheral walls 62 to form a concave periphery for aligning and centering the applicator 12 on the cable 14. In addition, the walls 62 are provided with many short projections 64 to minimize surface contact with the cable 14, and avoid removal of a fresh layer of coating material. The small surface area of each projection prevents prolonged surface contact with the cable 14, and the small amount of coating displaced by the projection is basically replaced by the flowable nature of the coating.

Figure 8:
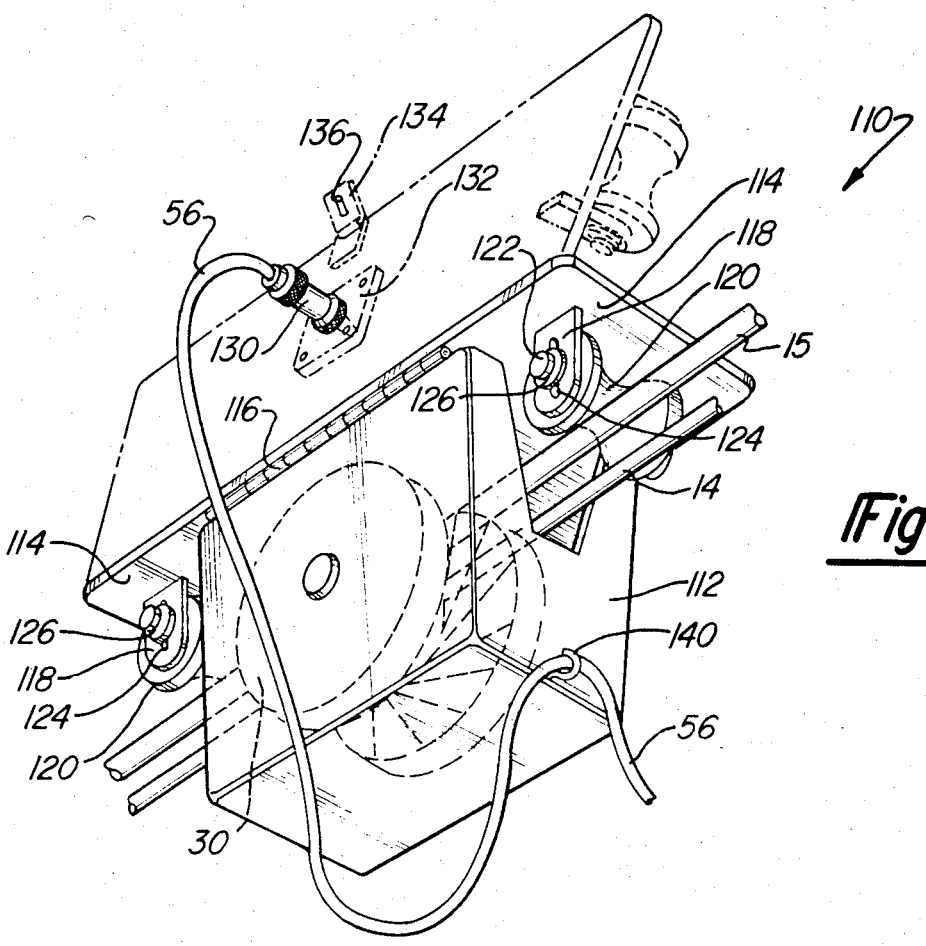
FIG. 8 is a perspective view showing a modified applicator constructed in accordance with the present invention.

Referring now to FIG. 8, an applicator 110 according to the present invention is thereshown comprising a housing 112 adapted to rotatably support a coating roller 30 in substantially the same manner as the housing 24. A lid 114 is secured to the housing 112 by a hinge 116 so that the lid 114 is pivotable to and between a first position which encloses the top of the housing 112 as shown in solid line in FIG. 8, and a second position which opens the top of the housing 112 as shown in phantom line in FIG. 8.

A pair of brackets 118 extend outwardly from the lower surface of the lid 114 to rotatably support support rollers 120. The axles 122 are lockingly engaged in elongated slots 124 in the brackets 118 by nuts 126 threadably engaged in threaded ends of the axles 122. Thus the height of the support rollers 120 above the coating roller 130 is adjustable so that the applicator can be used with dual cable suspension systems even though the distance between the cables 15 and 14 may vary from system to system. Although the lid 114 is substantially longer than the housing 112 so that the support rollers 120 are supported outside the coating reservoir formed by the housing 112 to prevent the build-up of coating on those support rollers, the support rollers can also be mounted to the lid 114 so as to extend within the coating reservoir without departing from the scope of the invention.

The lid 114 also supports a high pressure nozzle 130 above the coating roller 30 by the means of a mounting plate 132. The nozzle 130 is positioned to discharge coating in a spray pattern downwardly toward the coating roller 30 through an aperture in the lid 114 as it is delivered by the conduit 56. Thus, unlike the form of the invention shown in FIGS. 1–7, the conduit 56 serves only as a supply line to the coating resrvoir formed by the housing 112.

In addition, a locking plate 134 is pivotally secured to the lid 114 at the edge opposite to the hinge 116 so that it can pivot downwardly against the side of the housing 112. The locking plate 134 includes an elongated slot 136 adapted to receive a rotatably elongated projection 138 (FIG. 9) so as to entrain the lid 114 against the top of the housing 112 and stably position the nozzle 130 over the coating roller 30.

Figure 9:
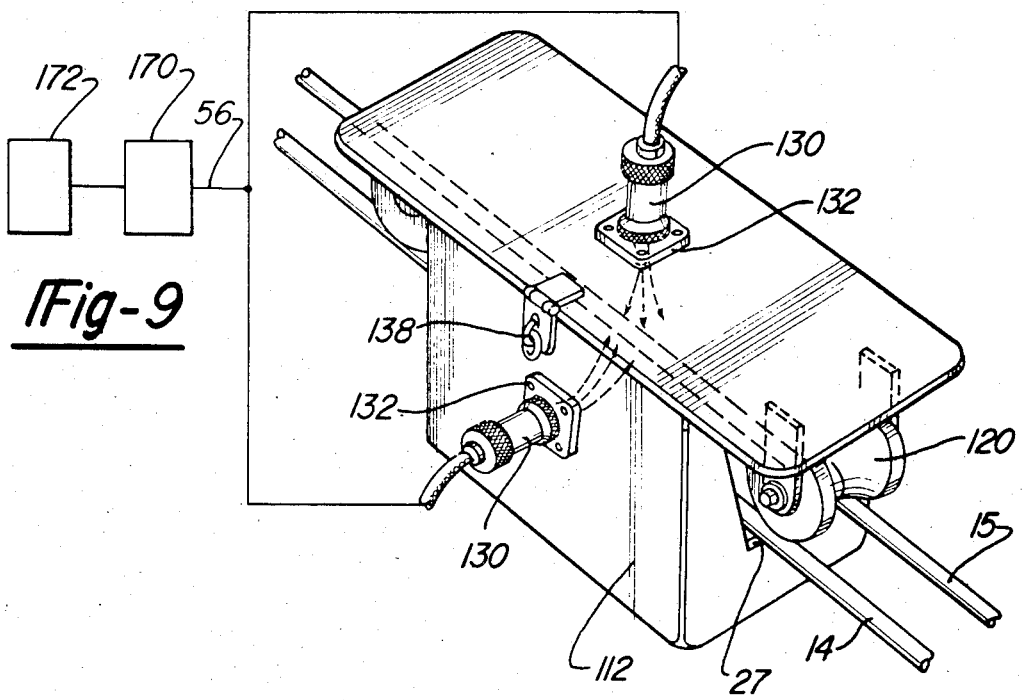
FIG. 9 is a perspective view showing a further modified applicator according to the present invention.

As shown in FIG. 9, in another embodiment, an additional nozzle 130 is mounted by a mounting plate 132 to the side of housing 112. The additional nozzle 130 replaces the coating roller 30. Although the angle at which the nozzle 130 directs the discharged coating toward cable 14 can be varied throughout a wide range depending on the position of the nozzle 130 with respect to the housing 122, it is preferable that the side mounted nozzle be positioned below the edge of recessed portion 27 and angled upwardly toward the center of the housing 112. Consequently, the cable 14 can be completely coated with a minimum number of nozzles.

Nevertheless, each nozzle 130 receives a supply of coating fluid from a supply reservoir 16 by the fluid conduit 56. Preferably, the switch means 70 and the pump 18 are replaced by a switch 170 for selectively operating a high pressure, low volume pump 172 known in the trade as an airless pump which generates a highly pressurized flow of fluid. Such a pump generates a high pressure fluid, for example, 2000 psi, without high pressure air being intermixed therewith. Furthermore, in the form of the invention shown in FIG. 9, it will be understood that even though the position of each nozzle 130 is fixed, the position of the axles 122 of the support rollers 120 is adjustable so that the applicator can be stably supported by the support cable 15 regardless of the distance between the cables 15 and 14.

Preferably, a control line for displacing the housing 112 along a cable can be formed from the conduit 56. When using a high pressure pumping source, it can be appreciated that the conduit 56 will be substantially reinforced to prevent bursting of the line. As a result, the conduit 56 can be pulled by an operator to displace the housing 112 along the cable. Preferably, a hook 140 is secured near the middle of the housing 112 so that the pulling force does not twist or disorient the housing on the cable.

A person operating the applicator 12 can scale a pole from which the cables 14 and 15 are suspended and pull the housing 112 along the cables 14 and 15 as the coating is supplied to the conduit 56. When the housing 112 reaches a point near the pole at which it can be grasped by the operator, the lid 114 is manually opened so that the applicator 12 becomes disengaged from the cable and can be repositioned on the cable extending from the other side of the pole. The housing 112 is then urged upwardly so that the cables 14 and 15 are entrained within the depression formed by of recessed edge 27 in the end wall of the housing 112, the lid 114 is closed over the top of the housing 112, and the rotatable projection 138 is latched to the locking plate 134. The applicator 12 can then be traversed along the cable toward the next pole after the operator has repositioned himself at an adjacent pole.

The form of applicator housing 112 shown in FIGS. 8 and 9 is especially well adapted for coating larger diameter, single cables. It may be appreciated that the housing 12 shown in FIGS. 1–7 could become difficult to manipulate in the manner described if it is enlarged to recieve cables of relatively large diameter, for example, three to six inch diameter cables.

Having thus described the present invention, many modifications thereto will become apparent to those skilled in the art to which it pertains without departing from the scope and spirit of the present invention defined in the appended claims.

What is claimed is:

1. An applicator for applying a flowable coating to a suspended cable comprising:

a supply reservoir, an open top housing defining a coating reservoir therein, fluid passage means between and in fluid communication with said supply and coating reservoirs for supplying said coating reservoir with the coating and for draining the coating from said coating reservoir, said fluid passage means comprising a conduit means for defining a single flow passageway in fluid communication with said supply and coating reservoirs, said passageway being the sole fluid means for supplying and draining fluid to and from said coating reservoir, means for selectively maintaining a predetermined level of fluid in said coating reservoir, a coating roller having a circumferential groove adapted to receive the cable therein, and means for rotatably supporting said roller in said housing so that at least a portion of said roller is immersed in said coating reservoir.

2. The invention as defined in claim 1 and further comprising supporting means for detachably suspending said housing from said cable.

3. The invention as defined in claim 2 wherein said housing has at least one side and said supporting means comprises at least one roller extending over said groove in said coating roller and means for supporting said roller from said side of said housing.

4. The invention as defined in claim 2 wherein said suspending means comprises at least one roller and means for supporting said at least one roller over said groove in said coating roller.

5. The invention as defined in claim 1 wherein said means for maintaining a predetermined level of coating in said reservoir comprises:

pumping means for reversibly pumping coating between said supply reservoir and said coating reservoir through said single passageway and means for automatically controlling said pumping means in response to the detection of a fluid level in said coating reservoir different than said predetermined level.

6. The invention as defined in claim 5 and further comprising means for manually controlling said pumping means.

7. The invention as defined in claim 1 wherein the depth of said groove in said coating roller is greater than the diameter of said cable so that said cable is confineable within the radially outermost edge of said coating roller.

8. The invention as defined in claim 7 wherein said groove tapers radially inwardly toward the center of said coating roller.

9. The invention as defined in claim 1 wherein said groove is defined by edge walls tapering radially inwardly toward the bottom of said groove.

10. The invention as defined in claim 9 wherein said housing includes recessed wall portions aligned with said coating roller and extending below the bottom of said groove.

11. The invention as defined in claim 1 wherein said fluid passage means comprises an elongated, rigid conduit and means for fixedly securing said conduit to said housing in fluid communication with said supply and coating reservoirs.

12. The invention as defined in claim 1 wherein said conduit means comprises: an elongated, rigid conduit having said single passageway formed therein; and means for fixedly securing said conduit to said housing in fluid communication with said supply and coating reservoirs.

13. An applicator for applying a coating to suspended cable comprising:

an open top housing defining a coating reservoir said housing having one side and an opposite side;

fluid passage means in fluid communication with said coating reservoir for supplying said coating reservoir with said coating and for draining said coating from said coating reservoir;

a coating roller having a circumferential groove adapted to receive the cable therein;

means for rotatably supporting said coating roller in said housing so that at least a portion of said coating roller is immersed in said coating reservoir; and means for detachably suspending said housing from the cable comprising a first support bracket mounted to said one side of said housing and a first suspension roller rotatably mounted to said first support bracket, said first suspension roller extending outwardly from said first support bracket to define a first opening for receiving said cable, said first opening positioned above said opposite side of said housing, said means for detachably suspending said housing further comprising a second support bracket mounted to said opposite side of said housing and a second suspension roller rotatably mounted to said second support bracket and extending outwardly from said second support bracket to define a second opening for receiving said cable, said second opening positioned above said one side of said housing such that said first and second suspension rollers may be placed upon the cable by aligning said first opening and said second opening beneath said cable and moving the housing upwardly and then rotating said housing to position said first and second suspension rollers above said cable for engagement of said cable.

14. The invention as defined in claim 13 wherein said first and second support brackets have means for resiliently maintaining said first and second suspension rollers over said groove in said coating roller.

15. The invention as defined in claim 14 wherein said means for resiliently maintaining said first and second suspension rollers comprise said first and second support brackets being made of resilient and flexible material.

16. The invention as defined in claim 14 wherein said means for resiliently maintaining said first and second suspension rollers comprises means for securing said first and second support brackets to said housing.

17. The invention as defined in claim 13 wherein said fluid passage means comprises an elongated, rigid conduit and means for fixedly securing said conduit to said housing in fluid communication with said reservoir.

18. An applicator for applying a coating to suspended cable comprising:

an open top housing defining a coating reservoir, means defining a single fluid passageway in fluid communication with said coating reservoir, said single passageway being the sole means for supplying said coating reservoir with said coating, a coating roller having a circumferential groove adapted to receive the cable, means for rotatably supporting said coating roller in said housing so that at least a portion of said coating roller is immersed in said coating reservoir, and means for detachably suspending said housing from the cable comprising at least one first suspension roller and first means for rotatably supporting said suspension roller over said groove from one side of said housing, wherein said means for rotatably supporting said at least one suspension roller comprises a lid and means for pivotally securing said lid to one side of said housing.

19. The invention as defined in claim 18 and further comprising nozzle means for discharging a spray of coating into said coating reservoir.

20. An applicator for applying a flowable coating to a suspended cable comprising:

an open top housing defining a coating reservoir, means for defining a single fluid passageway, said passageway being the sole means for supplying coating to said reservoir, said means for defining a single fluid passageway having means for discharging fluid under pressure into said housing, and means for detachably suspending said housing from the cable, wherein said detachably suspending means comprises a lid, means for pivotally securing said lid to said housing so that said lid is pivotable between a first position covering the open top of said housing and a second position angularly displaced from the open top, at least one support roller, and means for rotatably mounting said support roller to said lid.

21. The invention as defined in claim 20 wherein said means for discharging comprises at least one nozzle, and further comprising means for securing one of said at least one nozzle to said lid such that said nozzle fluidly communicates with said reservoir.

22. The invention as defined in claim 21 wherein said applicator comprises a grooved coating roller and means for rotatably mounting said roller in said housing under said nozzle.

23. The invention as defined in claim 21 and further comprising an airless, high pressure pump, and means for coupling said pump in fluid communication with said at least one nozzle.

24. The invention as defined in claim 20 wherein said means for discharging comprises at least two nozzles and means for mounting said nozzles so that they discharge coating at circumferentially spaced positions about said cable.

25. The invention as defined in claim 20 wherein said means for rotatably mounting comprises means for adjusting the position of the axis of each of said support rollers with respect to said lid.

26. The invention as defined in claim 20 wherein said lid is formed from a flat plate.

27. The invention as defined in claim 20 wherein said lid is longer than said housing and includes end portions extending outwardly beyond said housing, and wherein each of said means for rotatably mounting said at least one support roller is mounted to said end portions of said lid, such that said support rollers are positioned outside of said reservoir.

* * * * *